US005367163A

United States Patent [19]

Otsuka et al.

[11] Patent Number: 5,367,163

[45] Date of Patent: Nov. 22, 1994

[54] SAMPLE ANALYZING INSTRUMENT USING FIRST AND SECOND PLASMA TORCHES

[75] Inventors: Kiichiro Otsuka; Mitsuyasu Iwanaga, both of Tokyo, Japan

[73] Assignee: Jeol Ltd., Tokyo, Japan

[21] Appl. No.: 167,517

[22] Filed: Dec. 14, 1993

[30] Foreign Application Priority Data

Dec. 17, 1992 [JP] Japan ..... 4-337043

[51] Int. Cl.[5] ..... H01J 49/02

[52] U.S. Cl. ..... 250/288; 250/281

[58] Field of Search ..... 250/281, 288, 282, 423 R; 356/315; 315/111.21, 111.81

[56] References Cited

U.S. PATENT DOCUMENTS 4,760,253 7/1988 Hutton ..... 250/288
4,886,966 12/1989 Matsunaga et al. ..... 250/288
4,999,492 3/1991 Nakagawa ..... 250/281
5,051,584 9/1991 Gray et al. ..... 250/288
5,223,711 6/1993 Sanderson et al. ..... 250/281
5,308,977 5/1994 Oishi et al. ..... 250/281

*Primary Examiner*—Constantine Hannaher
*Assistant Examiner*—James Beyer
*Attorney, Agent, or Firm*—Webb Ziesenheim Bruening Logsdon Orkin & Hanson

[57] ABSTRACT

An analytical instrument using a plasma is disclosed. The instrument includes two plasma torches, a first torch of which is used for vaporizing a sample and a second plasma torch is used for exciting the sample. When the analytical instrument is a mass spectrometer, the sample vaporized by the first plasma torch is introduced into the second plasma torch where the sample is ionized. The sample is then mass analyzed. If the sample is a small solid sample, it is momentarily vaporized by the plasma flame generated from the first plasma torch. If the sample is a large solid sample, it can be gradually vaporized from its surface. Therefore, the sample can be analyzed without requiring any pretreatment, e.g., dissolving the sample in an acid.

19 Claims, 5 Drawing Sheets

SAMPLE ANALYZING INSTRUMENT USING FIRST AND SECOND PLASMA TORCHES

FIELD OF THE INVENTION

The present invention relates to an analytical instrument using a plasma, e.g., an inductively coupled plasma mass spectrometer (ICP-MS) in which an inductively coupled plasma (ICP) ion source is coupled to a mass spectrometer (MS).

BACKGROUND OF THE INVENTION

A conventional ICP-MS instrument is first described by referring to FIG. 1. This instrument comprises an ICP ion source 1 which is composed of a plasma torch 3 made of an electrical insulator such as quartz, a nebulizer 21 for atomizing liquid sample 6, and an argon gas source 22 for supplying argon gas to both torch 3 and nebulizer 21. An RF (radio frequency) coil 2 is wound around the torch 3. A sample bottle 5 holds the sample 6 and is connected with the nebulizer 21 via an intake pipe 7. The torch 3 with the RF coil 2 is surrounded by a grounded shield case (not shown) to prevent leaking of RF fields from the RF coil 2.

An interface 8 comprises a sampling cone 9 made of an electrical conductor, a first skimmer 10, and a second skimmer 11. A mass spectrometer 12 incorporates a mass analyzer 13 consisting either of a quadrupole mass spectrometer or of a double-focusing mass spectrometer having both an electric sector and a magnetic sector.

An oil diffusion pump 14 acts to maintain the inside of the mass spectrometer 12 as a high vacuum. A rotary oil-seal pump 15 evacuates a space $S_1$ formed between the sampling cone 9 and the first skimmer 10 via an evacuation pipe 17. Similarly, an oil diffusion pump 16 evacuates a space $S_2$ formed between the first skimmer 10 and the second skimmer 11 via an evacuation pipe 18.

Electrodes 19 converge ions to direct them into the mass analyzer 13. Accelerating electrodes 20 are mounted between the second skimmer 11 and the electrodes 19. Since the kinetic energies of ions to be analyzed are restricted within a range from 0 to 20 eV in quadrupole mass spectrometry, the sampling cone 9 and the skimmers 10, 11 are placed at ground potential. A negative voltage of the order of $-100$ V is applied to the accelerating electrodes 20.

In case a double-focusing mass spectrometer is used as the mass analyzer, an accelerating voltage, i.e., 3,000–5,000 V, is applied to the sampling cone 9 and skimmer 10 and the skimmer 11 is placed at ground potential.

In the structure described above, argon gas is supplied into the plasma torch 3 from the argon gas source 22. The liquid sample 6 is introduced as atomized form into the torch 3 from the nebulizer 21 via an inside pipe 23. Under this condition, when electric power is applied to the RF coil 2, an RF magnetic field is developed, thus producing a high-temperature plasma P. This plasma ionizes sample atoms. The resulting sample ions pass into the interface 8 through the sampling cone 9 and the skimmers 10, 11. The ions inside the interface are converged by the electrodes 19 and directed into the mass analyzer 13.

In the conventional ICP-MS instrument constructed as described above, when a sample is introduced into the plasma, the sample liquid is drawn and atomized by the nebulizer. The sample has been previously dissolved in an appropriate liquid. As an example, where the sample consists of a piece of rock, a semiconductor wafer, or other solid, the sample is dissolved in an acid to prepare a sample liquid. Such sample preparation procedures require a great deal of skill and a lot of time and expense. Furthermore, if the sample content of the liquid is relatively low, then high sensitivity cannot be obtained.

It is an object of the present invention to provide an analytical instrument using a plasma, which directly vaporizes a sample without any chemical or physical pretreatment and can introduce the sample into the plasma efficiently.

SUMMARY OF THE INVENTION

Briefly, according to this invention, there is provided an analytical instrument for analyzing a sample excited in a plasma comprises: a first plasma torch for generating a first plasma flame; a second plasma torch for generating a second plasma flame; a sample positioning means for placing a sample in a position where the sample is ablated by the first plasma flame; a sample gas collection means for extracting the sample ablated by the first plasma flame; a sample gas transfer means for supplying the gaseous sample into the second plasma flame, the gaseous sample being extracted via the sample gas collection means; and an analyzing means for analyzing the sample excited within the second plasma flame.

In the present invention, a first plasma torch for ablating a sample, as by eroding, melting, evaporating or vaporizing, is provided independent of a second torch used to excite the sample. The first torch produces a plasma flame for ablating the sample. The obtained sample gas is introduced into the second plasma torch, where the sample gas is excited, e.g., ionized. The plasma flame generated by the first plasma torch momentarily vaporizes the whole sample if it is a small piece of solid. If the sample is a large mass of solid, the surface can be gradually vaporized. Consequently, the sample can be analyzed without the necessity of dissolving the sample in an acid, i.e., without requiring any pretreatment.

Other objects and features of the invention will appear in the course of the description thereof, which follows.

DETAILED DESCRIPTION OF THE INVENTION

Figure 1:
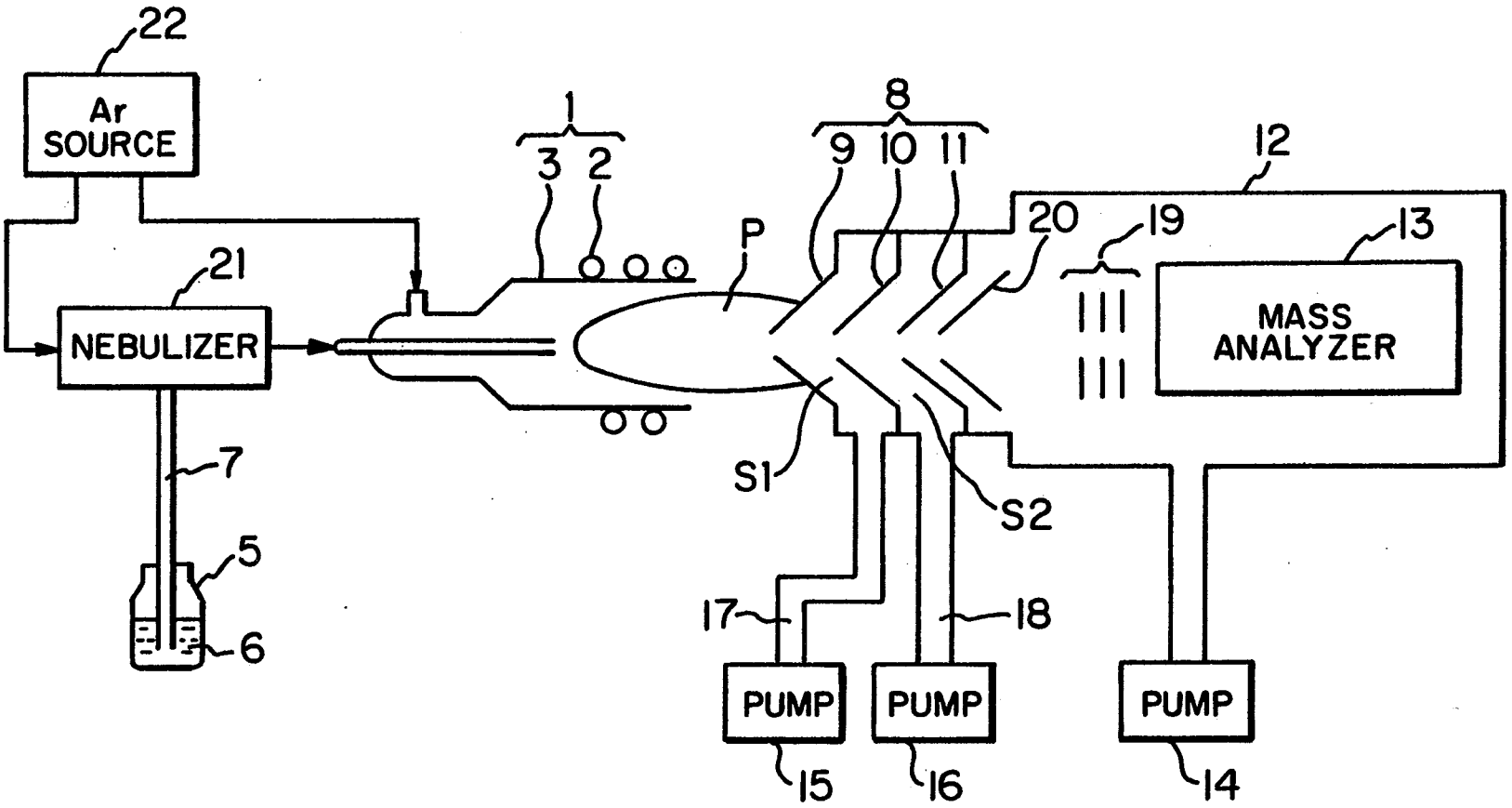
FIG. 1 PRIOR ART
FIG. 1 is a schematic view of a conventional, inductively coupled plasma mass spectrometer.
Figure 2:
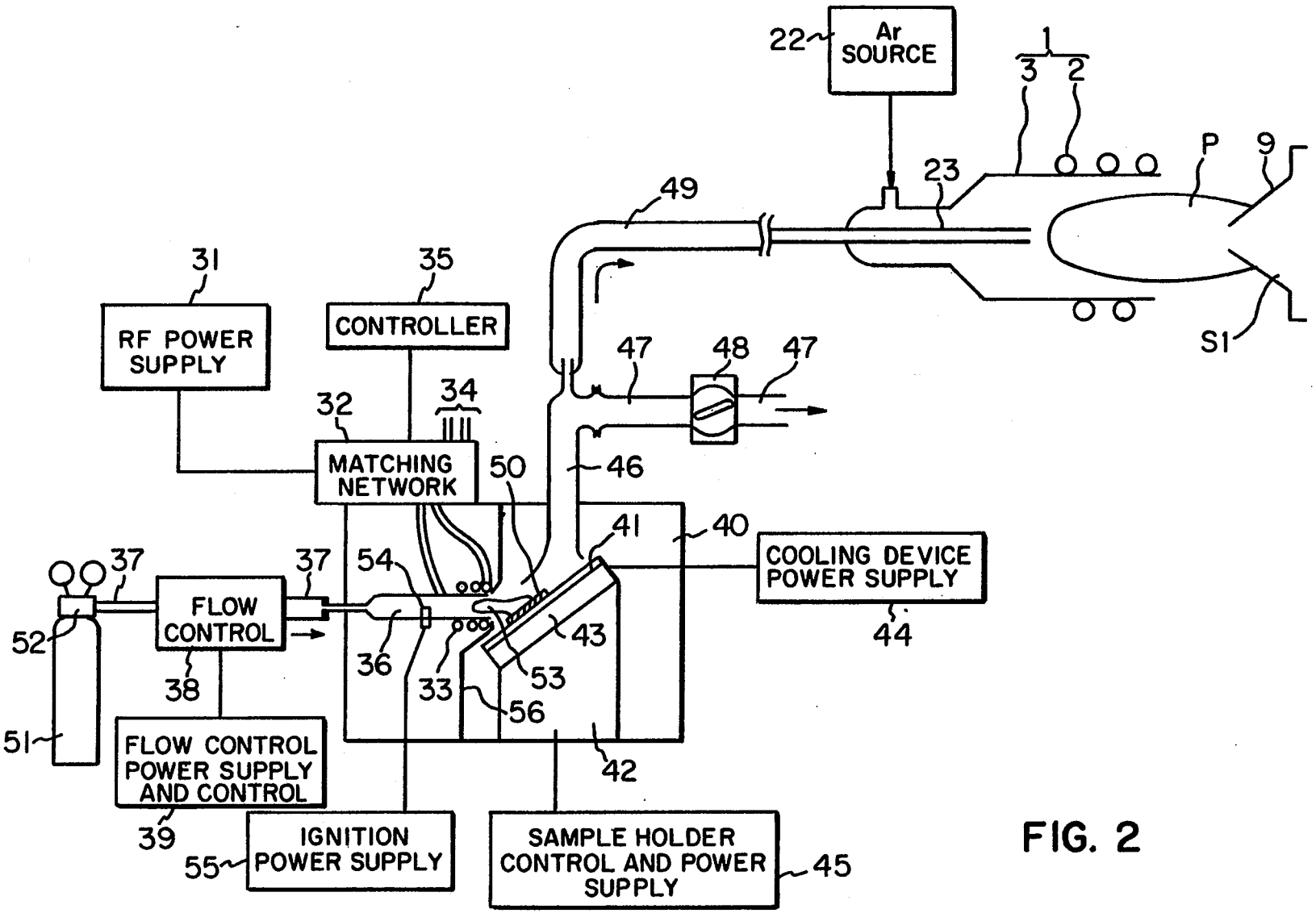
FIG. 2 is a schematic view of an inductively coupled plasma mass spectrometer according to the invention.

Referring to FIG. 2, there is shown an ICP-MS instrument according to the present invention. It is to be noted that like components are indicated by like reference numerals in both FIG. 1 and FIG. 2. The ICP-MS instrument shown in FIG. 2 is similar to the instrument shown in FIG. 1 except that the nebulizer of the instrument shown in FIG. 1 is replaced by a vaporization chamber 40 holding a sample and vaporizing it by a plasma flame, a plasma torch 36 placed inside the chamber 40, a power supply for the torch 36, a plasma gas supply portion for supplying plasma gas into the plasma torch 36, and an outlet portion for directing the vaporized sample into a mass spectrometer.

Mounted inside the vaporization chamber 40 are a sample holder 41 on which a sample 50 is placed, a sample holder-translating-and-rotating mechanism 42 operated by a power supply-and-control unit 45, and a sample holder-cooling device 43 operated by a power supply 44.

The power supply for the plasma torch 36 comprises an RF power supply 31, a matching network 32, a working coil 33, a cooling water supply/discharge pipe 34, a matching network controller 35, an ignition electrode 54, and an ignition power supply 55.

The plasma gas supply portion comprises an argon gas source 51, a pressure-reducing valve 52, an argon gas supply tube 37, a gas flow controller 38, and a power supply-and-control unit 39.

The outlet portion comprises a vaporized gas collection tube 46, a vaporized gas evacuation tube 47, a butterfly valve 48, and a connection tube 49.

The plasma torch 36 is positioned inside the vaporization chamber 40. The wall of the chamber 40 can prevent leakage of the RF field from the RF coil 33. The solid sample 50 such as a semiconductor wafer is placed on the sample holder 41 at a position at which the front end of the plasma flame emitted from the plasma torch reaches. The plasma torch 36 generates an argon plasma flame 53 at 8,000–10,000K, the flame 53 being blown against the surface of the sample 50. The sample stage 41 is translated in three dimensions and rotated within the plane containing the sample surface by the sample-translating-and-rotating mechanism 42, which is in turn operated by the power supply-and-control unit 45. By appropriately combining these translating motions and rotation, the plasma can impinge the whole surface of the sample uniformly or the preselected small area of the sample 50. To prevent the whole sample from being melted and vaporized, the sample holder-cooling device 43, which makes use of Peltier elements or the like and is operated by the cooling power supply 44, cools the rear surface of the sample. Consequently, the sample vaporizes from the surface on which the plasma flame impinges. Instead of using the sample holder-cooling device 43 fabricated from Peltier elements, the rear surface of the sample may be cooled by passing coolant, e.g., cold water or liquid nitrogen, through a pipe attached to the sample holder 41.

Argon gas is supplied into the plasma torch 36 through the argon gas supply tube 37. Gas supplied from the argon gas source 51 via the pressure-reducing valve 52 is introduced into the plasma torch 36 under the control of the gas flow controller 38 at a flow rate, for example, of 14 liters/min. The controller 38 is controlled by the power supply-and-control unit.39. The argon gas supplied into the plasma torch 36 is RF heated by the working coil 33 wound around the torch. At the start, the ignition electrode 54 to which a high voltage is applied from the ignition power supply 55 produces an electric discharge to ignite the plasma. The plasma flame 53 blown from the plasma torch heats and vaporizes the sample.

RF power is supplied to the working coil 33 from the RF power supply 31 of a frequency 40 MHz and an output of 1.6 kW through a 50-Ω coaxial cable. The matching network 32 matches the impedance of this coaxial cable and the power supply 31. The matching network controller 35 causes the matching network 32 to automatically make the impedance matching. The working coil 33 is made of a hollow pipe through which cooling water is circulated via the supply/discharge pipe 34.

The gaseous sample evaporating from the surface of the sample by the plasma flame is collected through the collection tube 46 which branches into the connection tube 49 and the evacuation tube 47. The ratio of the flow rate of the sample flowing through the connection tube 49 to the flow rate of the sample flowing through the evacuation tube 47 is controlled by the butterfly valve 48. For example, the sample gas is evacuated via the evacuation tube 47; at a flow rate of about 13 liters/min. The remaining sample gas is supplied via the connection tube 49 into the plasma torch of the ICP-MS instrument at a flow rate of about 1 liter/min. The sample gas taken out via the connection tube 49 is introduced into the torch 3 through the inner pipe 23. The gas is then ionized by the plasma produced inside the torch 3. The resulting sample ions are introduced into the mass spectrometer via the sampling cone 9 and mass analyzed.

In this way, a plasma torch for vaporizing a sample is provided independent of the plasma torch of the ICP-MS instrument. The sample is directly vaporized by the plasma flame. Therefore, if the sample is a small solid sample, it is momentarily vaporized. If the sample is a large solid sample, it is gradually vaporized from its surface. Consequently, the sample can be analyzed without requiring any pretreatment, e.g., dissolving the sample in an acid. The sample can be introduced into the plasma efficiently without the need to make a pretreatment, which would have been required heretofore.

Figure 3:
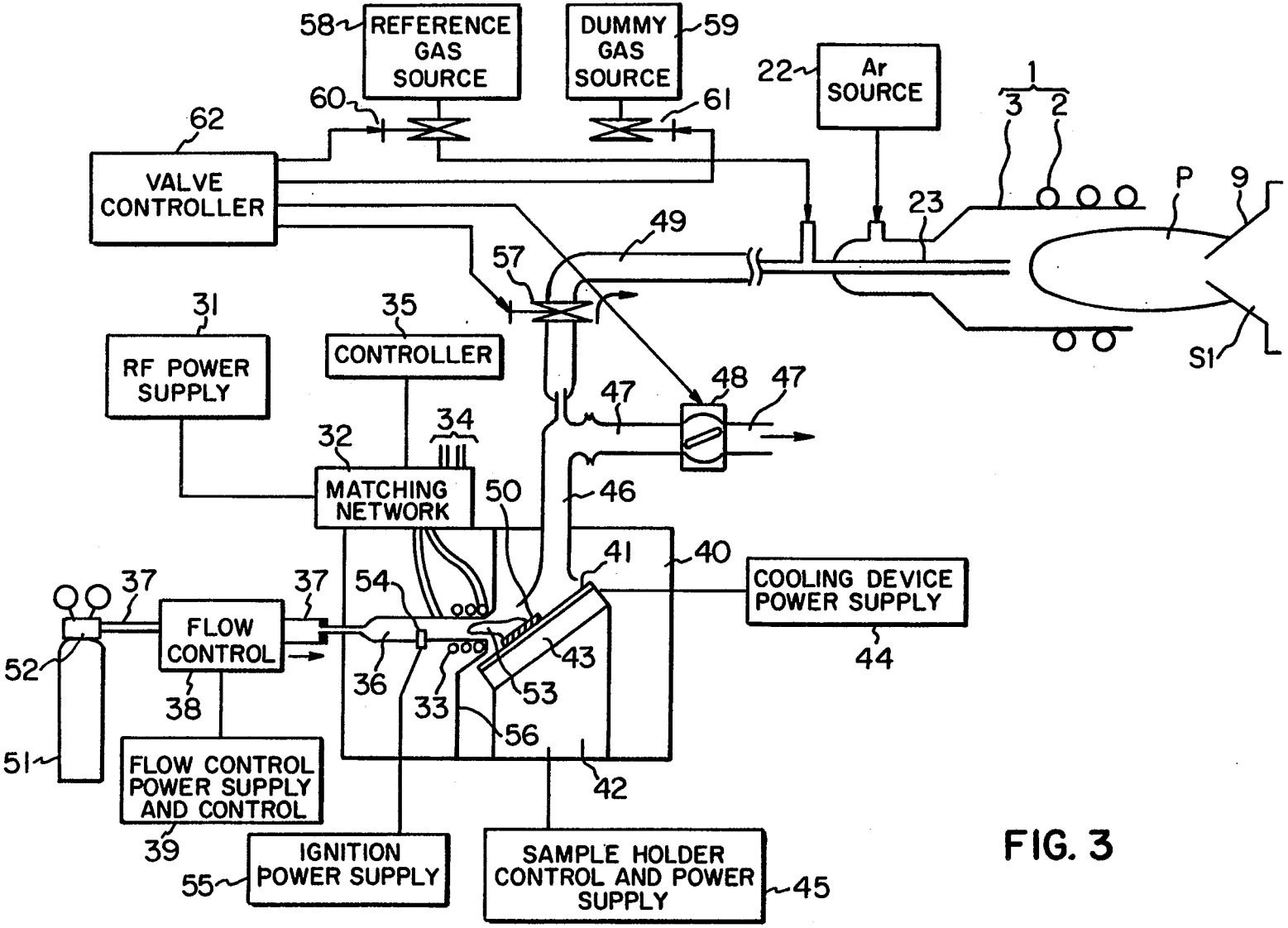
FIG. 3 is a schematic view of an inductively coupled plasma mass spectrometer having an automatic control for switching from a dummy gas to a sample gas according to the invention.

FIG. 3 shows another embodiment of the present invention. In this embodiment, a flow control valve 57, a reference gas source 58 with a flow control valve 60, a dummy gas source 59 with a flow control valve 61, and a valve controller 62 are added to the embodiment shown in FIG. 2.

Prior to the start of the instrument, the valves 48 and 61 are opened and the valves 57 and 60 are closed by the controller 62. Then, the torches 3 and 36 are ignited and stable plasma flames are generated and maintained. At such stable condition, the sample gas evacuated via the collection tube 46 at a flow rate of 14 liters/min. is exhausted via valve 48 and tube 47. On the other hand, a dummy gas (e.g., argon gas) from the source 59 is introduced into the torch 3 via the valve 61 and inner pipe 23 at a flow rate of 1 liter/min.

Next, the controller 62 opens the valve 57 gradually and simultaneously closes the valve 61 gradually. Through such open and close operations, the controller 62 controls the valves 57 and 61 in such a way that the flow rate of the gas supplied into the torch 3 via the inner pipe 23 is kept constant at 1 liter/min. Finally, the valve 61 is completely closed and the sample gas is supplied to the plasma flame in the torch 3 at the flow rate of 1 liter/min. Produced sample ions are introduced into the mass spectrometer via the sampling cone 9 and mass analyzed.

Since the changeover to the sample gas from the dummy gas is done without fluctuations of the flow rate, the plasma flame is kept stable during the changeover and extinguishing of the plasma flame can be effectively prevented.

By opening the valve 60 and supplying the reference gas into the torch 3 and the plasma flame, many peaks whose mass-to-charge ratios are known appear in the obtained mass spectrum. Such known mass peaks make it possible to correctly determine mass-to-charge ratios of unknown peaks in the mass spectrum according to the calibration procedure using the known mass-to-charge ratios.

Figure 4:
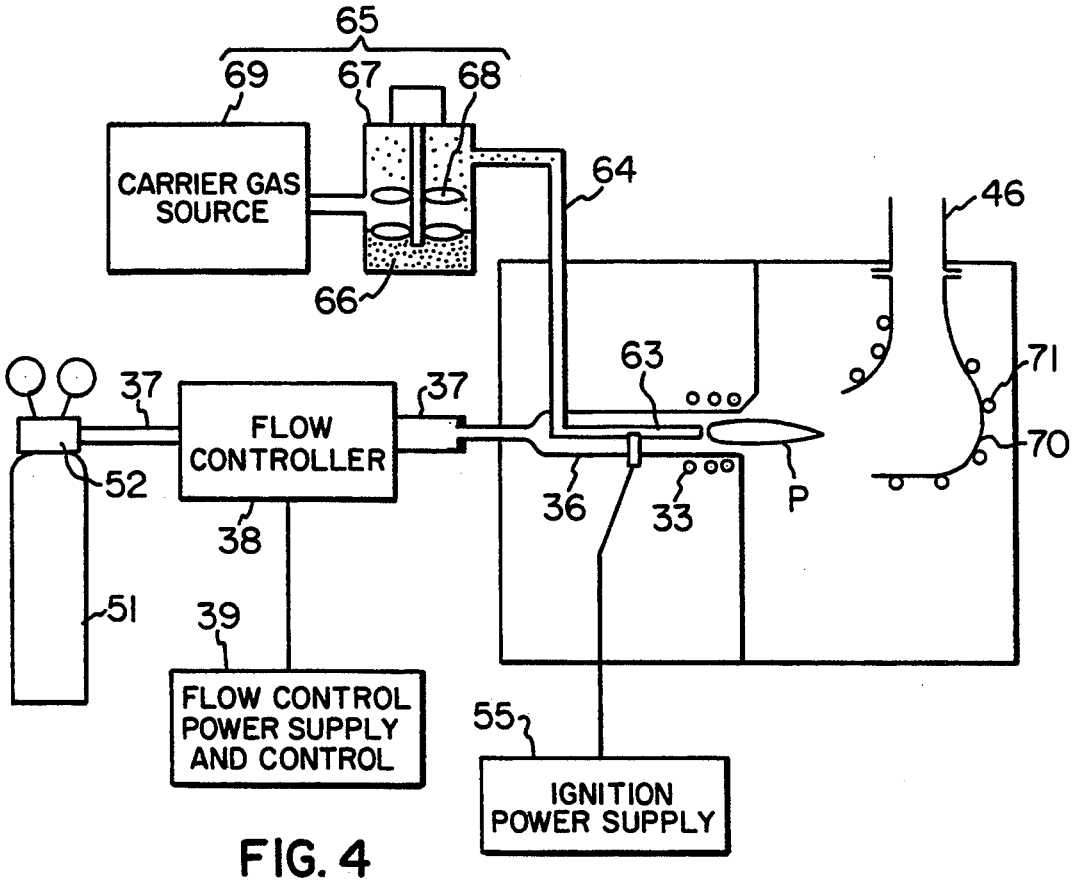
FIG. 4 is a schematic view of an inductively coupled plasma mass spectrometer in which a powdered sample is introduced according to the invention.

FIG. 4 shows another embodiment of the present invention. In this embodiment, a sample holder 41 and sample holder-translating-and-rotating mechanism 42 are eliminated. On the other hand, an inner tube 63 for introducing a powder sample into the torch 36, a transfer tube connected to the inner tube 63, and sample feeding mechanism 65 are additionally equipped.

The sample feed mechanism 65 comprises a storage chamber 67 for storing a powder sample 66, fans 68 for blowing up the sample 66, and a carrier gas source 69 for supplying a carrier gas into the storage chamber 67. The collection tube 46 has an entrance part 70 which has an extended entrance for receiving the plasma flame 53 effectively. In order to prevent vaporization and/or heat damages by the plasma flame 53, the entrance tube 70 is cooled by cooling pipe 71 in which a coolant such as cold water flows.

In such construction, the sample 66 blown up in the storage chamber 67 by the fans 68 is transferred continuously with the carrier gas into the torch 36 via the transfer tube 64 and the inner tube 63 and then vaporized by the plasma flame 53. Resulted sample gas is collected by the collection tube 46 and supplied to the torch 3.

Figure 5:
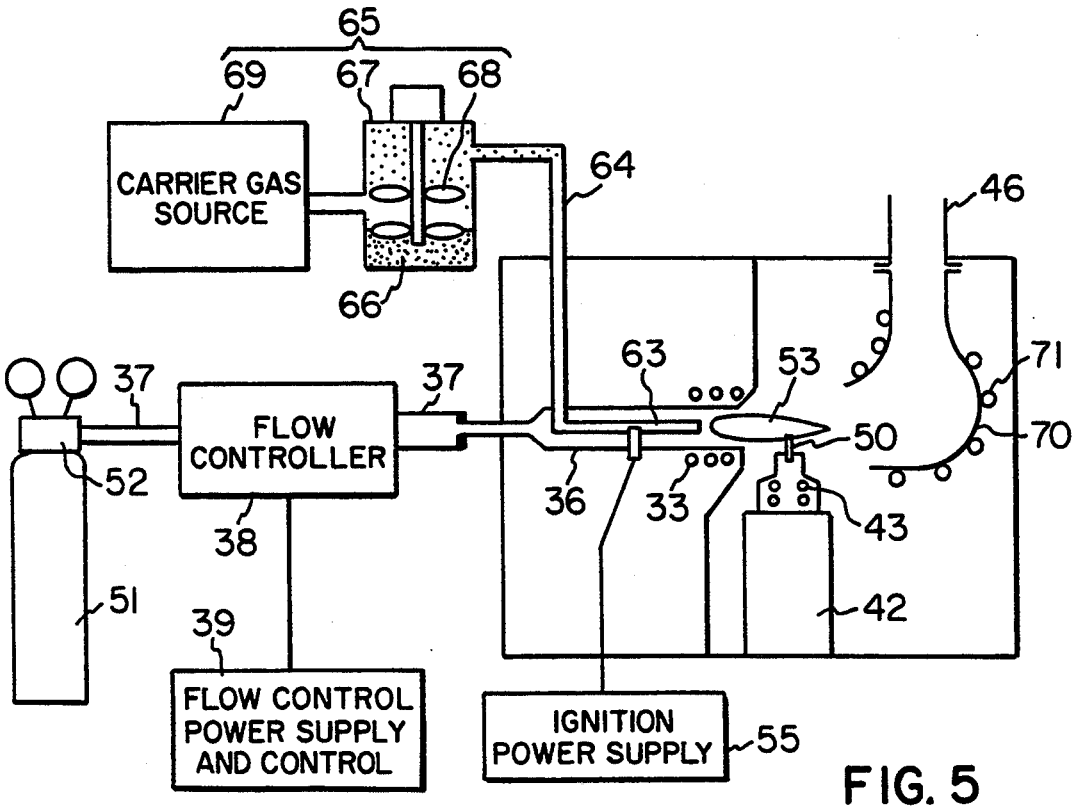
FIG. 5 is a schematic view of an inductively coupled plasma mass spectrometer in which a sample is held within the plasma according to the invention.

FIG. 5 shows another embodiment of the present invention. In this embodiment, the sample holder can chuck a piece of solid sample and the tip of the sample is inserted in the plasma flame 53. As a result, the tip of the sample is vaporized. The position at which the sample is inserted and the length of insertion into the plasma flame can be freely adjusted by the sample holder-translating-rotating mechanism 42. Furthermore, the sample holder is preferably cooled by the cooling device 43 to avoid melting and vaporizing.

Figure 6:
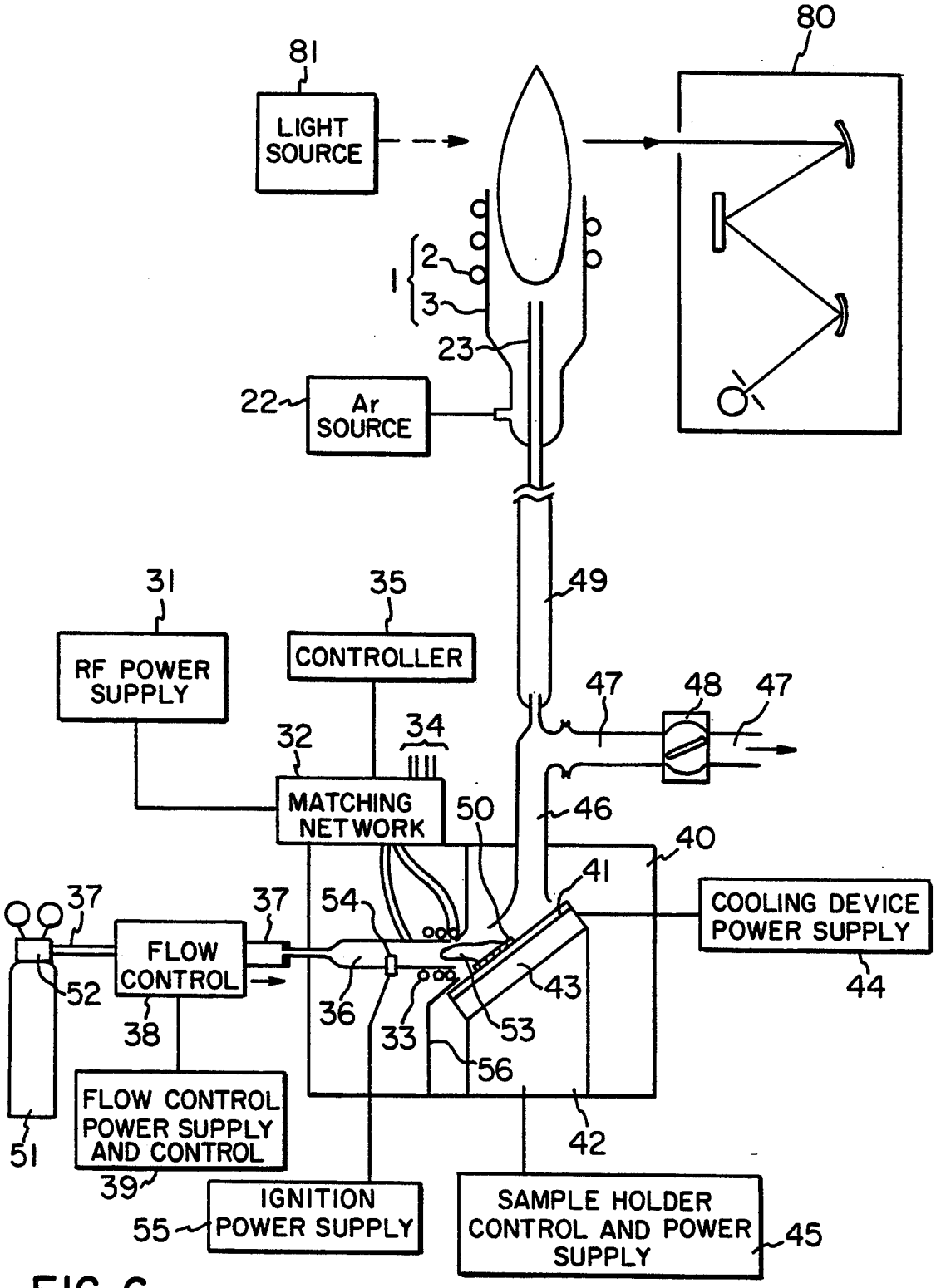
FIG. 6 is a schematic view of an inductively coupled plasma photo-emission spectrometer according to the invention.

FIG. 6 shows another embodiment of the present invention. In this embodiment, a photo-emission spectroscopy instrument 80 is combined with the plasma torch 3. Lights emitted from the excited sample in the plasma flame are introduced into the photo-emission spectrometry instrument.

When a light source 81 for directing a primary light to the plasma flame is added, and the light passed through and affected by the sample in the plasma flame is introduced into the spectroscopy instrument 80, an atomic absorption spectroscopy is enforceable.

Having thus been described, the present invention can also be applied to various analytical instruments which have a plasma torch and analyze samples by exciting them with a plasma.

Having thus described our invention with the detail and particularity required by the Patent Laws, what is claimed to be protected by Letters Patent is set forth in the following claims.

What is claimed is:

1. An analytical instrument for analyzing a sample excited in a plasma, comprising:

a first plasma torch for generating a first plasma flame;

a second plasma torch for generating a second plasma flame;

a sample positioning means for placing a sample in a position where the sample is ablated by said first plasma flame;

a sample gas collection means for extracting the sample vaporized by said first plasma flame and for transferring the collected gaseous sample into said second plasma flame; and means for analyzing the sample excited within said second plasma flame.

2. An analytical instrument using a plasma as set forth in claim 1, wherein said analyzing means is a mass analysis means.

3. An analytical instrument using a plasma as set forth in claim 2, wherein said sample positioning means is a sample holder which is disposed opposite to said first plasma torch and on which a solid sample is held such that the sample faces the first plasma torch.

4. An analytical instrument using a plasma as set forth in claim 3, wherein said sample holder is equipped with a cooling means for cooling the sample.

5. An analytical instrument using a plasma as set forth in claim 3, further comprising a sample translating means for translating the position of said sample relative to the first plasma flame.

6. An analytical instrument using a plasma as set forth in claim 3, wherein said sample is arranged in a chamber which is separated from said second plasma torch and into which the first plasma flame is introduced.

7. An analytical instrument using a plasma as set forth in claim 2, wherein said sample positioning means includes a powder supply means for continuously supplying a powdered sample into said first plasma flame.

8. An analytical instrument using a plasma as set forth in claim 2, wherein said sample positioning means includes a holder which permits the held sample to be inserted into said first plasma flame.

9. An analytical instrument using a plasma as set forth in claim 2, wherein said sample gas collection means has a splitter for supplying a part of said gaseous sample into said second plasma flame.

10. An analytical instrument using a plasma as set forth in claim 9, further comprising valve means to stop the flow of the gaseous sample to the second plasma flame splitted by said splitter, and dummy gas supply means for supplying a dummy gas into said plasma flame when the flow of the gaseous sample is stopped by said valve means.

11. An analytical instrument using a plasma as set forth in claim 1, wherein said analyzing means is an optical analysis means for measuring emission or absorption of light by said excited sample in said second plasma flame.

12. An analytical instrument using a plasma as set forth in claim 11, wherein said sample positioning means is a sample holder which is disposed opposite to said first plasma torch and on which a solid sample is held such that the sample faces the first plasma torch.

13. An analytical instrument using a plasma as set forth in claim 12, wherein said sample holder is equipped with a cooling means for cooling the sample.

14. An analytical instrument using a plasma as set forth in claim 12, further comprising a sample translating means for translating the position of said sample relative to the first plasma flame.

15. An analytical instrument using a plasma as set forth in claim 12, wherein said sample is arranged in a chamber which is separated from said second plasma torch and into which the first plasma flame is introduced.

16. An analytical instrument using a plasma as set forth in claim 11, wherein said sample positioning means includes a powder supply means for continuously supplying a powdered sample into said first plasma flame.

17. An analytical instrument using a plasma as set forth in claim 1i, wherein said sample positioning means includes a holder which permits the held sample to be inserted into said first plasma flame.

18. An analytical instrument using a plasma as set forth in claim 11, wherein said sample gas collection means has a splitter for supplying a part of said gaseous sample into said second plasma flame.

19. An analytical instrument using a plasma as set forth in claim 18, further comprising valve means to stop the flow of the gaseous sample to the second plasma flame splitted by said splitter, and dummy gas supply means for supplying a dummy gas into said second plasma flame when the flow of the gaseous sample is stopped by said valve means.

* * * * *

UNITED STATES PATENT AND TRADEMARK OFFICE

CERTIFICATE OF CORRECTION

PATENT NO. 5,367,163

DATED November 22, 1994

INVENTOR(S) Kiichiro Otsuka and Mitsuyasu Iwanaga

It is certified that error appears in the above-indentified patent and that said Letters Patent is hereby corrected as shown below:

Title page, item [73], Assignee, "Jeol Ltd." should read --JEOL Ltd.--.

Column 3 Line 68 "unit.39." should read --unit 39.--.

Claim 17 Line 4 Column 8 "1i," should read --11,--.

Signed and Sealed this

Seventh Day of February, 1995

Bruce Lehman

*Attest:*

BRUCE LEHMAN

*Attesting Officer*

*Commissioner of Patents and Trademarks*